US009732744B2

(12) United States Patent
Yeh

(10) Patent No.: US 9,732,744 B2
(45) Date of Patent: Aug. 15, 2017

(54) DETACHABLE BALL INFLATION AND DEFLATION DEVICE

(71) Applicant: Sheng-Yi Yeh, Taoyuan County (TW)

(72) Inventor: Sheng-Yi Yeh, Taoyuan County (TW)

( * ) Notice: Subject to any disclaimer, the term of this patent is extended or adjusted under 35 U.S.C. 154(b) by 299 days.

(21) Appl. No.: 14/693,189

(22) Filed: Apr. 22, 2015

(65) Prior Publication Data

US 2016/0310801 A1 Oct. 27, 2016

(51) Int. Cl.

| | |
|---|---|
| ***F04B 45/04*** | (2006.01) |
| ***F04B 33/00*** | (2006.01) |
| ***F04B 39/10*** | (2006.01) |
| ***A63B 41/08*** | (2006.01) |
| ***A63B 41/12*** | (2006.01) |
| ***A63B 43/00*** | (2006.01) |

(52) U.S. Cl.
CPC ..... *F04B 45/04* (2013.01); *A63B 41/085* (2013.01); *A63B 41/12* (2013.01); *A63B 43/002* (2013.01); *F04B 33/00* (2013.01); *F04B 39/10* (2013.01)

(58) Field of Classification Search
CPC ..... A63B 41/02; A63B 41/12; A63B 43/002; A43B 13/202; A43B 13/203; F04B 33/00; F04B 39/0016; F04B 45/04; F04B 43/00; F04B 43/009; F16K 15/20; B60C 29/00; B60C 29/02; B60C 29/04
USPC ..... 473/603, 604, 610, 611; 417/479, 480
See application file for complete search history.

(56) References Cited

U.S. PATENT DOCUMENTS

| | | | | |
|---|---|---|---|---|
| 5,238,244 | A * | 8/1993 | Cotter | A63B 41/12 417/479 |
| 2004/0180740 | A1* | 9/2004 | Kennedy, III | A63B 41/12 473/593 |
| 2012/0157249 | A1* | 6/2012 | Yeh | A63B 41/085 473/604 |

* cited by examiner

*Primary Examiner* — Charles Freay
*Assistant Examiner* — Kenneth J Hansen
(74) *Attorney, Agent, or Firm* — Chun-Ming Shih

(57) ABSTRACT

A detachable ball inflation and deflation device is disposed in a cavity of a ball. The device includes an air inflation unit, a non-return unit, and a reinforcement sleeve. By applying a force to press the air inflation unit repeatedly, the air outside the ball passes the non-return unit to enter the inside of the ball so as to inflate the ball, and the air filled into the ball won't deflate. The device has the function to deflate the ball in a quick way. When the air inflation unit is pulled out of a portion of the ball, the air inside the ball can be deflated quickly, so that the ball can be carried and stored conveniently.

4 Claims, 8 Drawing Sheets

3
38
302
39
301
32
31

DETACHABLE BALL INFLATION AND DEFLATION DEVICE

BACKGROUND OF THE INVENTION

1. Field of the Invention

The present invention relates to a detachable ball inflation and deflation device, without using a tool for air inflation and air deflation.

2. Description of the Prior Art

Ball games are favorable sports. For playing the game smoothly, the inside of the ball must be kept with sufficient air pressure for the ball to bounce and fly normally. When the air pressure inside the ball is not enough, the user has to inflate the ball in advance so as to keep a normal function of the ball.

In general, it is necessary to use an air pump and an inflation needle for inflating the ball. Without these tools, it is difficult to inflate the ball.

Sometime, the user wants to carry and storage the ball conveniently, so the air inside the ball is deflated. This also needs a ball needle to exhaust the air inside the ball. This way consumes time and is inconvenient. If the user wants to play the ball again, he/she still needs to inflate the ball with the air pump. This is very inconvenient.

Accordingly, the inventor of the present invention has devoted himself based on his many years of practical experiences to solve these problems. The device of present invention combines the inflation function and deflation function, such that the user can inflate the ball conveniently, play the ball anytime, deflate the ball anytime, and carry and storage the ball conveniently.

The present invention changes the appearance of the ball and increases the function of the ball because the outer surface of the ball is provided with a built-in inflation button for inflating the ball directly or deflating the ball. Besides, the inflation unit and the deflation unit can be replaced and maintained.

Accordingly, the inventor of the present invention has devoted himself based on his many years of practical experiences to solve these problems.

SUMMARY OF THE INVENTION

The primary object of the present invention is to provide a detachable ball inflation and deflation device to solve the above-mentioned problems, without using a tool to enhance the convenience of air inflation and air deflation for balls.

A further object of the present invention is to provide a detachable ball inflation and deflation device which is convenient for replacement when the air inflation and deflation deice is damaged.

In order to achieve the aforesaid object, the detachable ball inflation and deflation device of the present invention is disposed in a cavity of a ball. The ball has a space inside. The space is adapted for air inflation. The cavity is disposed at a proper location inside the ball. The cavity is formed with an inner wall. The inner wall has an opening. The inflation and deflation device comprises an air inflation unit, a non-return unit, and a reinforcement sleeve.

The air inflation unit is shaped like an airbag. One end face of the air inflation unit is formed with an air inlet. After assembled, the air inlet is located at the outer edge face of the ball. Another end face of the air inflation unit, opposite to the air inlet, is formed with an air inflation opening. The air inflation opening is tightly coupled with the non-return unit. The non-return unit penetrates through the opening of the cavity of the ball to communicate with the space inside the ball.

The non-return unit is a one-way valve and comprises a first stop ring and a second stop ring. Through the first stop ring and the second stop ring, the non-return unit is clamped at the air inflation opening. The bottom of the non-return unit is provided with a stopper. The inside of the stopper has an accommodation space therein. The accommodation space is provided with a valve member. The valve member is biased by an elastic member. The non-return unit has a first sense line and a second sense line thereon. The non-return unit is longitudinally formed with a through passage and a groove.

The reinforcement sleeve is a hollow sleeve fitted on the air inflation unit for keeping the configuration of the air inflation unit.

DETAILED DESCRIPTION OF THE PREFERRED EMBODIMENTS

Figure 1:
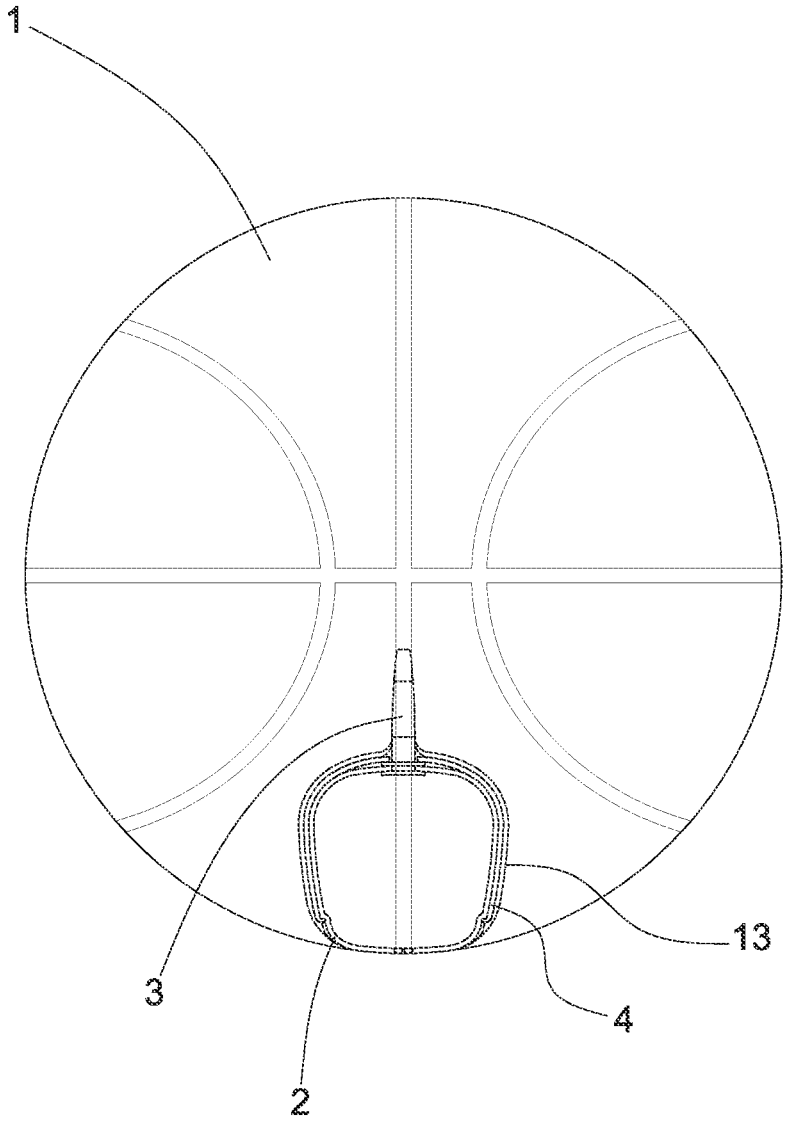
FIG. 1 is a perspective view of the present invention.

Embodiments of the present invention will now be described, by way of example only, with reference to the accompanying drawings.

As shown in FIG. 1, FIG. 2, FIG. 3, and FIG. 4, the present invention discloses a detachable ball inflation and deflation device which is disposed in a ball 1, in particular, located in a cavity 12 of the ball 1. The ball 1 has a space 11 inside. The space 11 is adapted for air inflation. The cavity 12 is disposed at a proper location inside the ball 1. The cavity 12 is formed with an inner wall 13. The inner wall 13 has an opening 13.

The inflation and deflation device of the present invention comprises an air inflation unit 2, a non-return unit 3, and a reinforcement sleeve 4. The air inflation unit 2 is shaped like an airbag. One end face of the air inflation unit 2 is formed with an air inlet 21. After assembled, the air inlet 21 is located at the outer edge face of the ball 1. Another end face of the air inflation unit 2, opposite to the air inlet 21, is formed with an air inflation opening 22. The air inflation opening 22 communicates with the space 11 inside the ball 1. The air inflation unit 2 has an air room 23 therein. The non-return unit 3 is coupled to the air inflation opening 22. The non-return unit 3 is a one-way valve. One end edge of the non-return unit 3 is provided with a first stop ring 31 and a second stop ring 32 spaced from the first stop ring 31. By the first stop ring 31 cooperating with the second stop ring 32, the non-return unit 3 is clamped at the air inflation opening 22. An outer end of the non-return unit 3 is concaved with an accommodation space 34. An outer edge of the accommodation space 34 is provided with a stopper 33. The stopper 33 has a through hole 331 therein. The accommodation space 34 is provided with a valve member 36 and an elastic member 37 therein. In a normal state, the valve member 36 is biased by the elastic member 37 to block the through hole 331. The inner bottom of the accommodation space 34 is formed with a through passage 38 toward an inner end of the non-return unit 3. The outer wall of the non-return unit 3 has a groove 39 extending from the second stop ring 32 toward the inner end of the non-return unit 3. The non-return unit 3 is formed with a first sense line 301 and a second sense line 302. The area between the first sense line 301 and the second stop ring 32 is defined as a clamping area. The area between the first sense line 301 and the second sense line 302 is defined as an air deflation area.

Figure 2:
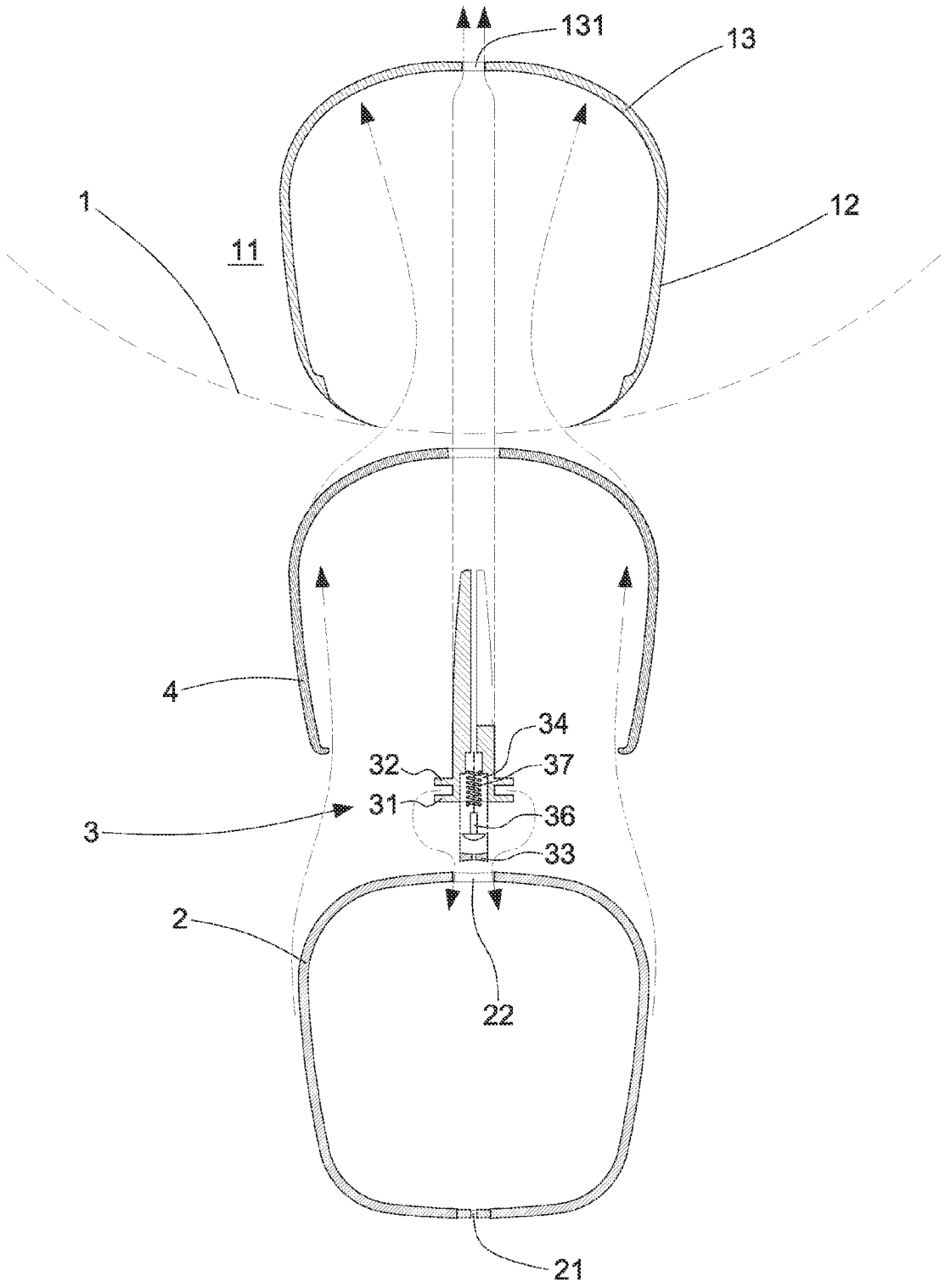
FIG. 2 is a partial sectional and exploded view of the present invention.
Figure 3:
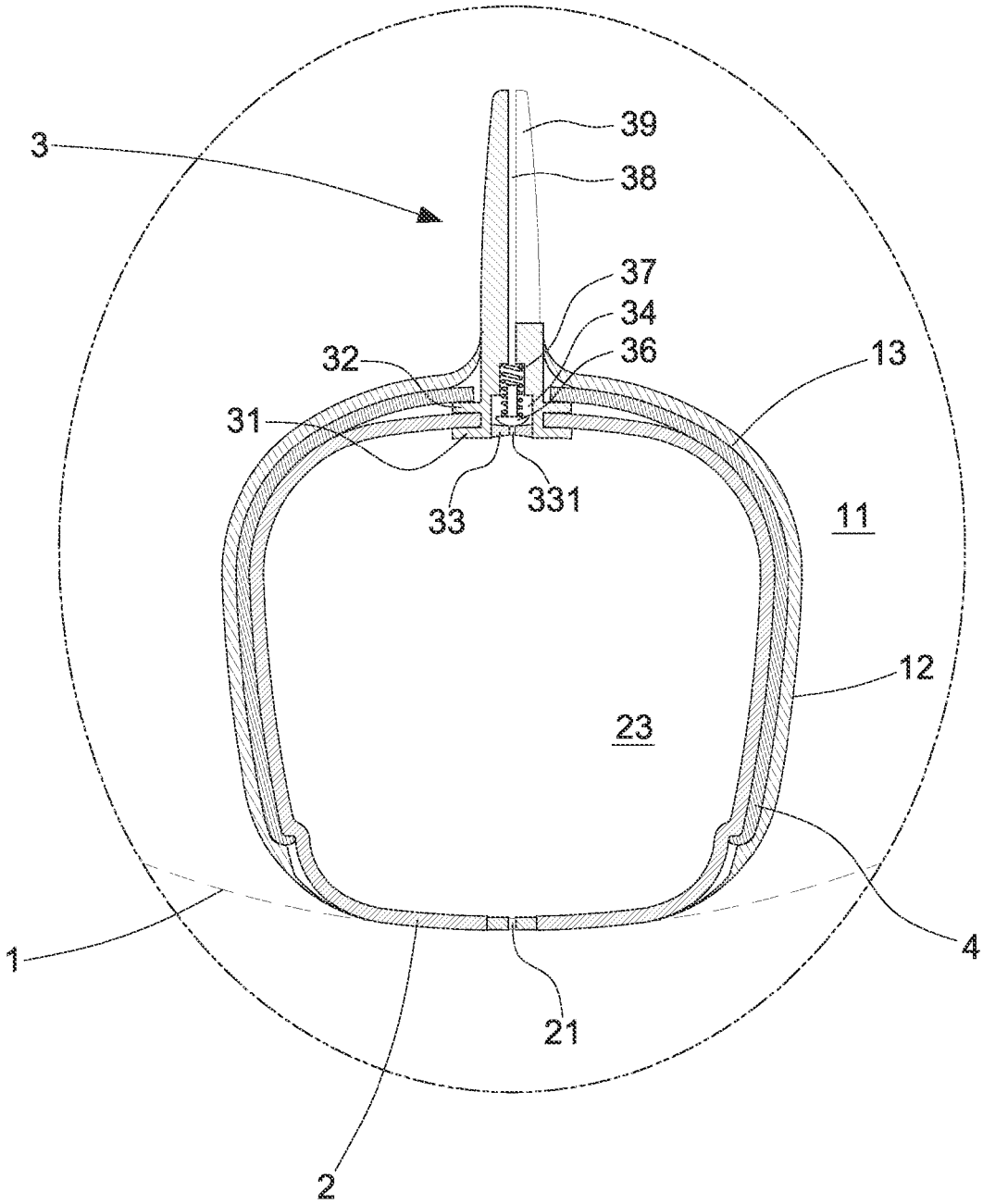
FIG. 3 is a sectional view of the present invention.
Figure 4:
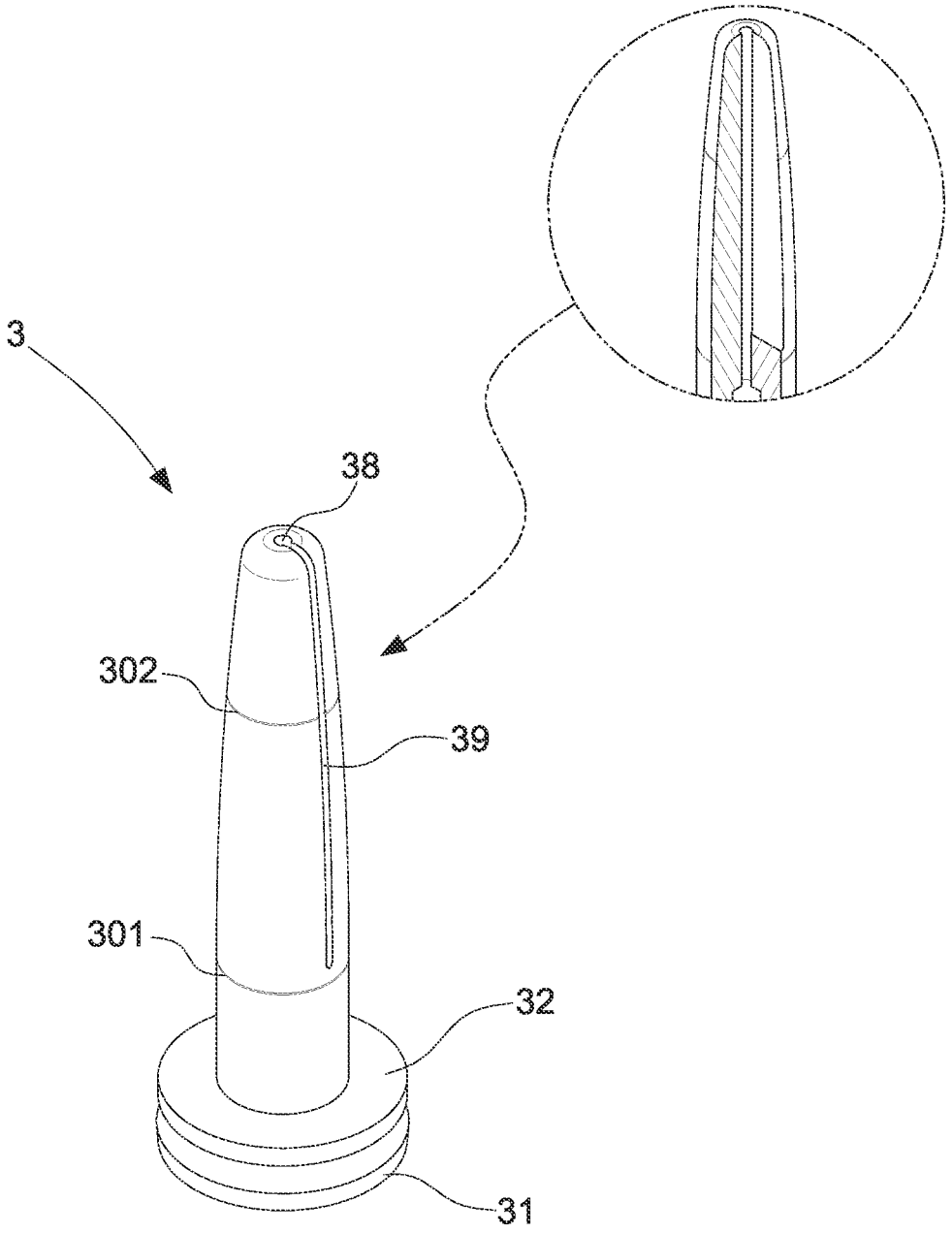
FIG. 4 is a perspective view of the non-return unit of the present invention.

The reinforcement sleeve 4 is a hollow sleeve fitted on the air inflation unit 2 for keeping the configuration of the air inflation unit 2. As shown in FIG. 2, the air inflation unit 2 and the non-return unit 3 are coupled to the inner wall 13 of the cavity 12 of the ball 1 in an assembly way. Specifically, after the first stop ring 31 passes through the air inflation opening 22 and the opening 131, by cooperating with the second stop ring 32, the non-return unit 3 is clamped at the air inflation opening 22 and the opening 131. Thus, the air inflation unit 2 and the non-return unit 3 of the present invention can be detached from the cavity 12 of the ball 1.

The air inflation unit 2 of the present invention is made of a deformable material.

Figure 5:
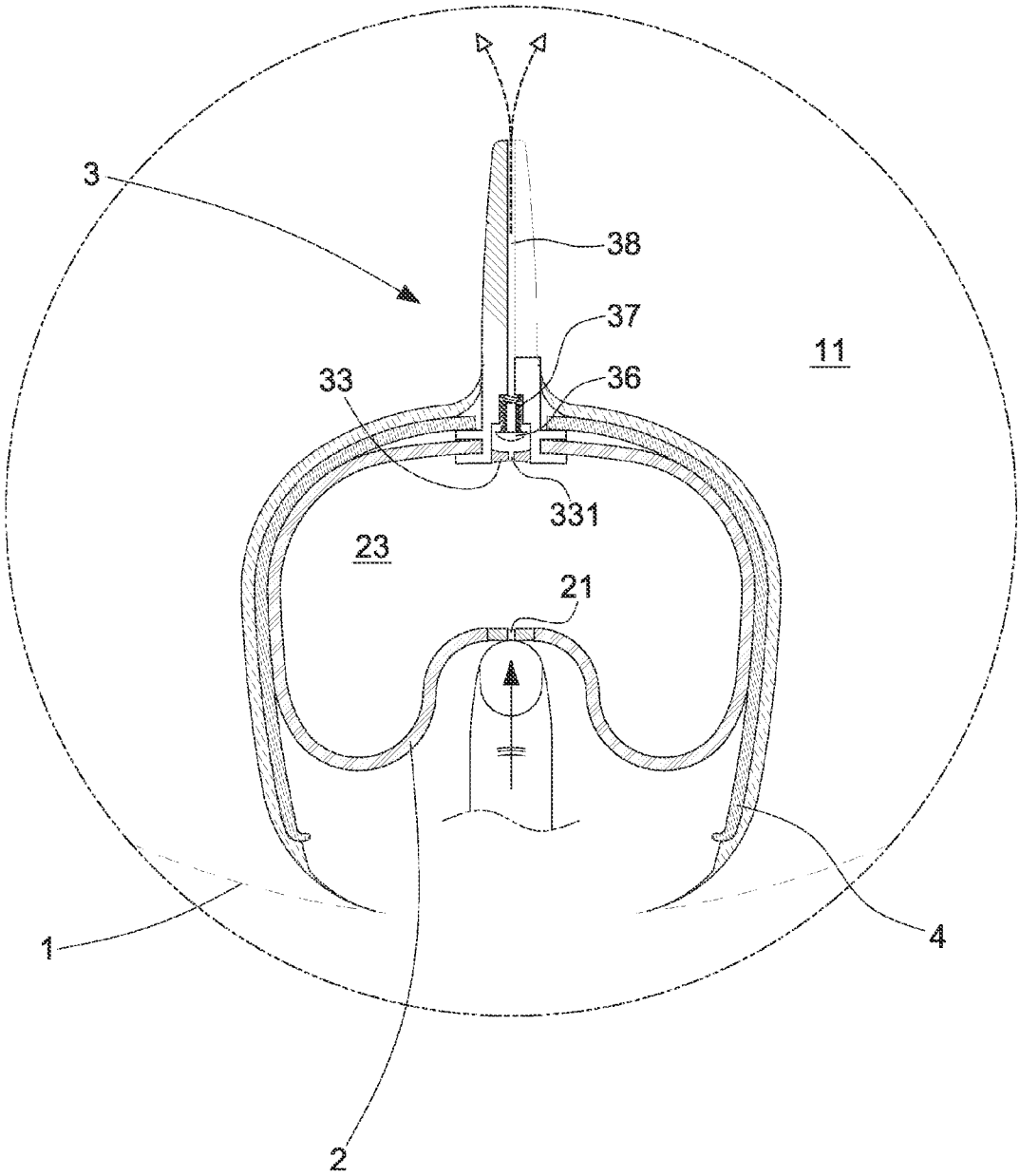
FIG. 5 is a schematic view showing the operation of air inflation of the present invention.
Figure 6:
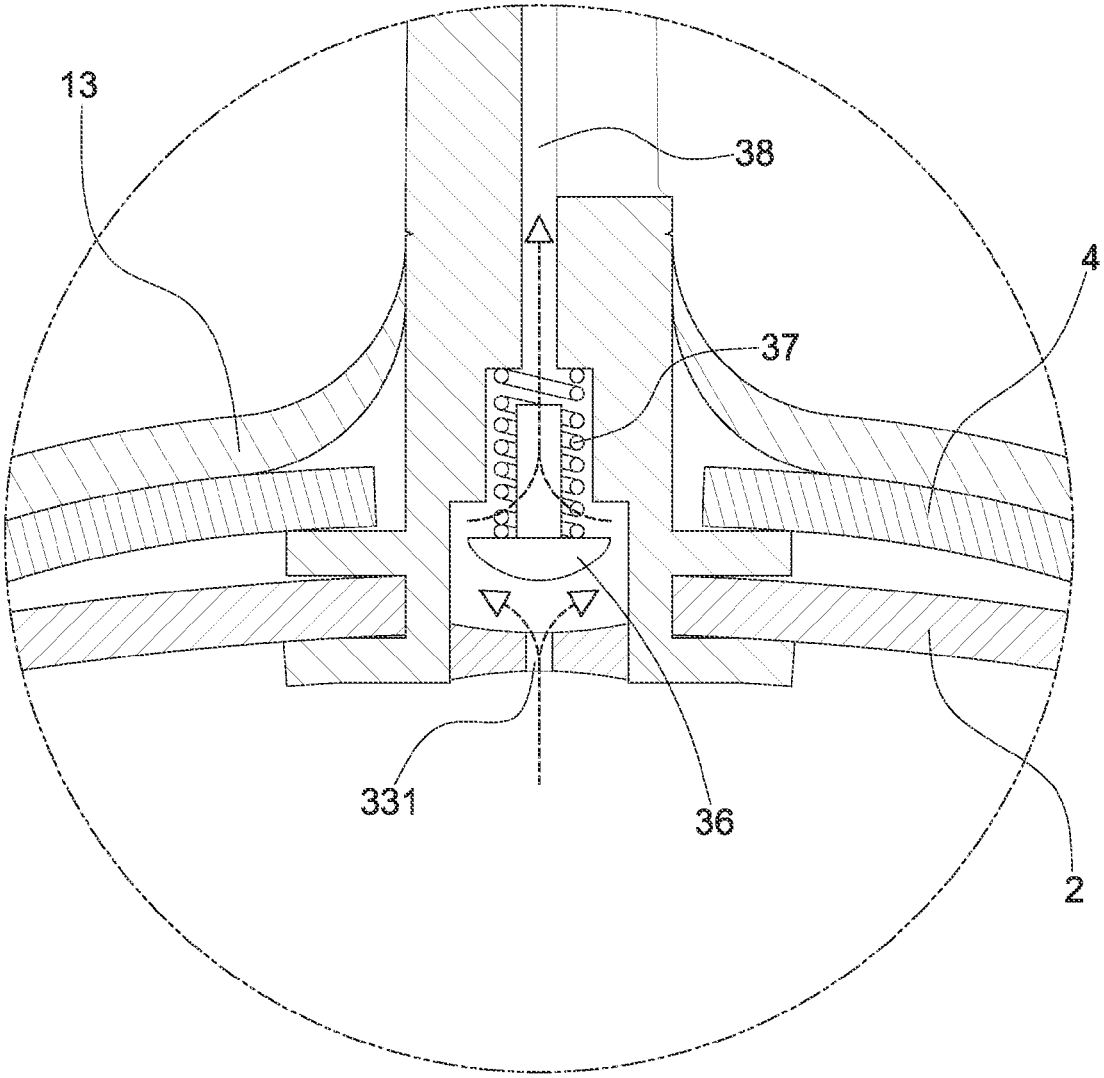
FIG. 6 is a schematic view showing that the valve member of the non-return unit of the present invention is opened for air ventilation.

As shown in FIG. 5, when the ball needs inflating, the air inlet 21 of the air inflation unit 2 is applied with a force with hands, so that the air inlet concaves inward. After the air inflation unit 2 is compressed, the air in the air room 23 of the air inflation unit 2 will enter the through hole 331 to push away the valve member 36, as shown in FIG. 6, to compress the elastic member 37, such that the air flows into the passage 38 to enter the space 11 of the ball 1. After a brief pause of pressing the air inflation unit 2, along with the deformation of the air inflation unit 2, the air inflation unit 2 will restore automatically. The air is inhaled into the air room 23 of the air inflation unit 2 from the air inlet 21. By the elasticity of the elastic member 37, the valve member 36 is biased to close the through hole 331, preventing the air in the space 11 of the ball 1 from flowing out. To repeat the press, the space 11 of the ball 1 can be filled with air to complete air inflation.

The non-return unit 3 of the present invention is formed with the groove 39 extending from the first sense line 301 to the second sense line 302. Through the groove 39, when the non-return unit 3 is pulled out of the air inflation opening 22 and the opening 131, the groove 39 can release pressure and ventilation. This is beneficial to pull the non-return unit 3 out.

Figure 7:
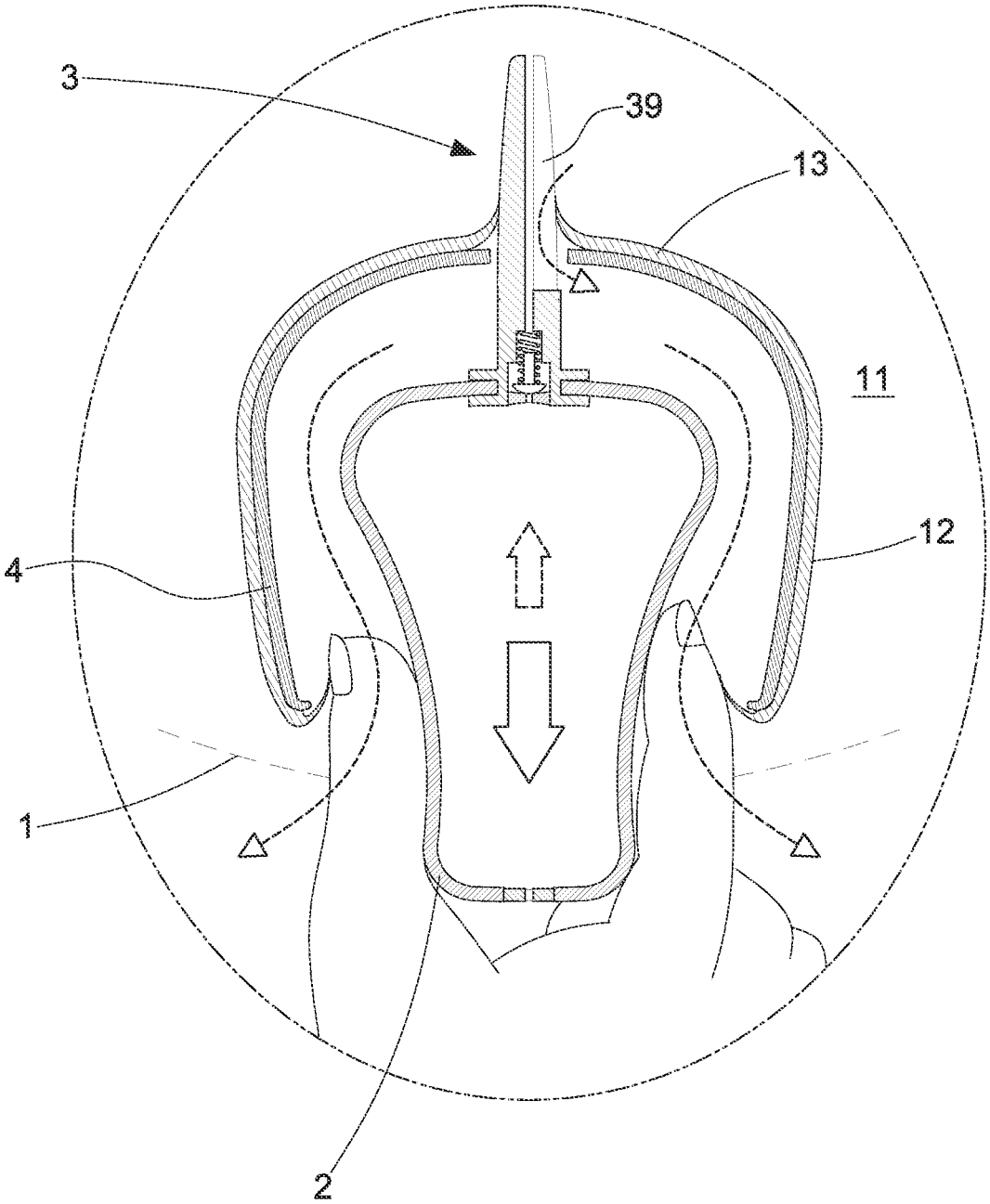
FIG. 7 is a schematic view showing that the air inflation unit of the present invention is taken out.

As shown in FIG. 7, when the user wants to take the air inflation unit 2 out, the air inflation unit 2 is pulled outward. When the groove 39 disengages from the air inflation opening 22, the groove 39 is to ventilate the interior pressure and the exterior pressure so that the air inflation unit 2 can be taken out smoothly.

Figure 8:
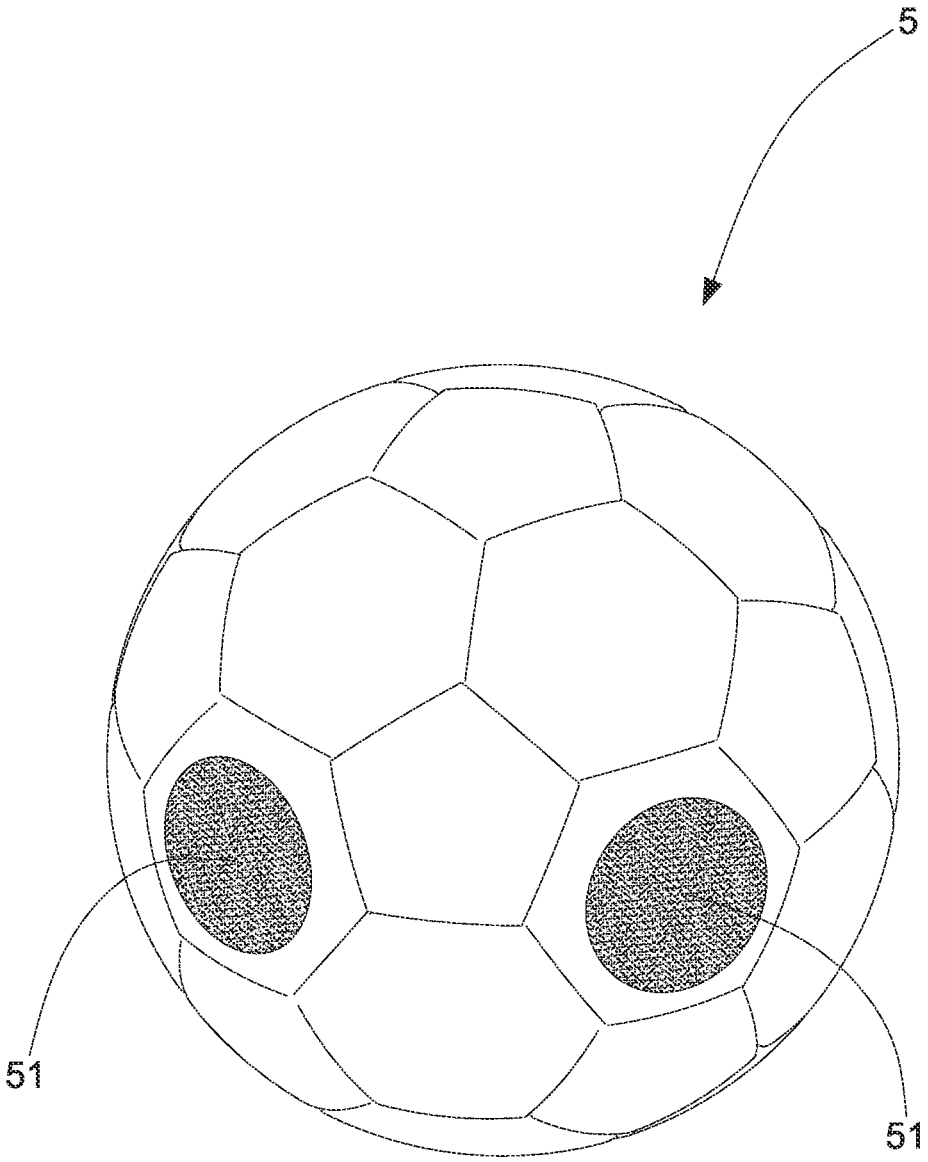
FIG. 8 is a schematic view of another embodiment of the present invention is taken out.

FIG. 8 shows another embodiment. The ball 5 can be provided with one or more than one air inflation and deflation devices.

Accordingly, the detachable ball inflation and deflation device of the present invention doesn't need a tool for air inflation and air deflation. Specially, it is detachable for maintenance or replacement of the parts.

Although particular embodiments of the present invention have been described in detail for purposes of illustration, various modifications and enhancements may be made without departing from the spirit and scope of the present invention. Accordingly, the present invention is not to be limited except as by the appended claims.

What is claimed is:

1. A detachable ball inflation and deflation device, disposed in a cavity of a ball, the cavity being formed with an inner wall, the inner wall having an opening, the device comprising an air inflation unit and a non-return unit;

one end face of the air inflation unit being formed with an air inlet, another end face of the air inflation unit, opposite to the air inlet, being formed with an air inflation opening, the air inflation opening communicating with a space inside the ball, the air inflation unit having an air room therein;

the non-return unit being coupled to the air inflation opening, the non-return unit being a one-way valve, one end edge of the non-return unit being provided with a first stop ring and a second stop ring spaced from the first stop ring, through the first stop ring and the second stop ring, the non-return unit being clamped at the air inflation opening, an outer end of the non-return unit being concaved with an accommodation space, an outer edge of the accommodation space being provided with a stopper, the stopper having a through hole therein, the accommodation space being provided with a valve member and an elastic member therein, in a normal state, the valve member being biased by the elastic member to block the through hole, an inner bottom of the accommodation space being formed with a through passage toward an inner end of the non-return unit, an outer wall of the non-return unit having a groove extending from the second stop ring toward the inner end of the non-return unit.

2. The detachable ball inflation and deflation device as claimed in claim 1, wherein the outer wall of the non-return unit is formed with a first sense line and a second sense line, and the groove is disposed between the first sense line and the second sense line.

3. The detachable ball inflation and deflation device as claimed in claim 1, wherein the air inflation unit is made of a deformable material.

4. The detachable ball inflation and deflation device as claimed in claim 1, wherein a reinforcement sleeve is provided and fitted on the air inflation unit.

* * * * *